US005735720A

United States Patent [19]

Gärtner et al.

[11] Patent Number: 5,735,720

[45] Date of Patent: Apr. 7, 1998

[54] CONTROLLABLE THERMIONIC ELECTRON EMITTER

[75] Inventors: Georg Gärtner, Aachen; Hans-Jürgen Lydtin, Stolberg, both of Germany

[73] Assignee: U.S. Philips Corporation, New York, N.Y.

[21] Appl. No.: 814,685

[22] Filed: Mar. 11, 1997

Related U.S. Application Data

[62] Division of Ser. No. 367,543, Jan. 3, 1995, abandoned.

[30] Foreign Application Priority Data

Jan. 8, 1994 [DE] Germany ..... 44 00 353.6

[51] Int. Cl.[6] ..... H01J 3/02; H01J 29/04

[52] U.S. Cl. ..... 445/24; 445/58; 445/49; 313/346 R; 313/346 DC; 313/310

[58] Field of Search ..... 445/58, 24, 49; 313/346 R, 346 DC, 310

[56] References Cited

U.S. PATENT DOCUMENTS

| | | | |
|---|---|---|---|
| 3,710,161 | 1/1973 | Beggs | 313/346 R |
| 3,843,902 | 10/1974 | Miram et al. | 313/346 R |
| 3,967,150 | 6/1976 | Lien et al. | 313/338 |
| 4,096,406 | 6/1978 | Miram et al. . | |
| 4,250,428 | 2/1981 | Oliver et al. | 445/58 |

FOREIGN PATENT DOCUMENTS

| | | |
|---|---|---|
| 4206909 | 9/1993 | Germany . |
| 4207220 | 9/1993 | Germany . |

*Primary Examiner*—Nimeshkumar Patel
*Attorney, Agent, or Firm*—Robert J. Kraus

[57] ABSTRACT

The invention relates to a controllable thermionic electron emitter for vacuum tubes, which comprises an emitter layer (3, 27) and a control layer (5) which is separated from the emitter layer by an insulating layer (4), with the insulating layer and the control layer being manufactured by a deposition process. Also when its dimensions are small, such an electron emitter can be dimensionally accurately manufactured. All functional elements of the controllable thermionic electron emitter, more particularly control layer(s) (5, 7, 22, 24), emitter layer (3, 27) and separating insulating layers (2, 4, 6, 21, 23, 25) are successively deposited on a substrate (1, 20) in the direction of growth, in such a manner that the layers adhere to each other via solid boundary layers. In operation and, in particular, when the temperature varies, the dimensional accuracy of the electron emitter is preserved within narrow limits, and said electron emitter has a long service life.

8 Claims, 1 Drawing Sheet

CONTROLLABLE THERMIONIC ELECTRON EMITTER

This is a division of application Ser. No. 08/367,543, filed Jan. 3, 1995, now abandoned.

The invention relates to a controllable thermionic electron emitter for vacuum tubes, which comprises a control layer which is separated from the emitter layer by an insulating layer, with the insulating layer and the control layer being manufactured by a deposition process.

BACKGROUND OF THE INVENTION

Electron emitters for vacuum tubes must combine a high electron emission with a sufficiently high resistance against residual-gas poisoning and ion bombardment. In addition, dependent on the field of application, the electron emitters must have a long service life. With respect to this, emissive layers made from very small particles having a diameter of less than 1 μm, as described in German application DE-A 4207220 or DE-A 4206909, are advantageous.

To focus and/or control the electron beam, use must be made of suitable focusing elements or grids whose distance from and position with respect to the cathode must be accurately maintained. When the necessary components are assembled from individual parts, relatively large variations in the positions are unavoidable. Particularly, when the desired interspace between the grid and the cathode ranges from 10 to 100 μm, enabling low control voltages, deviations from the permissible tolerance can cause the electron-beam profile to be distorted in an undesirable manner. In this case, a small variation in the operating data of less than 1% can no longer be maintained.

In flat displays, numerous cathode elements must be accurately spatially arranged so as to be close to each other. Positioning of separate cathode elements, for example by means of manually operated devices, is time consuming and problematic from the point of view of setting accuracy.

Controllable thermionic electron emitters of the type mentioned in the opening paragraph can be used, in particular, for

- TV and monitor tubes, for example direct vision-shadow mask tubes
- flat displays
- X-ray tubes
- klystrons
- transmitter and amplifier tubes, for example tetrodes
- gyrotrons
- scanning electron microscopes In TV and monitor tubes, the resolution can only be improved if a small distance between the cathode and the grid of, for example 80 μm, can be maintained with a tolerance of ±1 μm. The lateral tolerances must also be maintained sufficiently accurately in order to avoid an undesired lateral displacement of the so-called "crossover", i.e. the region where the peripheral electron beams intersect during focusing, and to avoid distortions of the electron beam spot on a phosphor screen.

Also in the case of X-ray tubes, it is deskable to improve the focusing of the electron beam. This is favourably influenced by a flat cathode having control grids which are arranged at a small distance above it. Also in the case of klystrons and UHF tubes as well as scanning electron microscopes, the aim should be to maintain the distance between the grid and the cathode within close tolerances. With respect to gyrotrons, it is important to manufacture the three-dimensional geometry and surface edge portion of the cathode as accurately as possible.

In U.S. Pat. No. 4,096,406 experiments are stated in which the cathode surface is coated with a network of an insulating material by means of a CVD process, whereafter the surface of the insulating material is provided with metal to form control electrodes. In these experiments, permanent poisoning of the emissive cathode surface occurred as a result of the coating processes.

SUMMARY OF THE INVENTION

It is an object of the invention to provide an electron emitter of the type mentioned in the opening paragraph, which, also when its dimensions are small, can be dimensionally accurately manufactured and whose dimensional accuracy during operation and, in particular, at different temperatures is preserved within narrow limits, and with the electron emitter having a long service life.

This object is achieved in that all functional elements of the controllable thermionic electron emitter, such as in particular the control layer, the emitter layer as well as the separating insulating layers are successively deposited on a substrate in the direction of growth, in such a manner that the layers adhere to each other via solid boundary layers.

In controllable thermionic electron emitters in accordance with the invention, all functional elements are combined to form a monolithic block. Subsequent processes for interconnecting and adjusting the functional elements, leading to inaccuracies, can be omitted. All layers of the inventive arrangement firmly adhere to each other via solid boundary layers, so that also high thermal loads do not cause impermissible changes in the geometric configuration. Many suitable methods of manufacturing such integrated structures are known and are also used, for example, in the manufacture of ICs. Even microstructures for matrix-like multiple-cathode arrangements can be manufactured with a high degree of dimensional accuracy. Also layer thicknesses below 20 μm can be produced with tolerances of less than 3%. Lateral distances between elements of a fine-structured multiple cathode can also be accurately realized, for example, by means of known etching processes.

Arrangements in accordance with the invention may be built up of one or more independently controllable control layers, enabling different functions to be fulfilled in a manner which is known per se. Metallic control layers can also be provided as ion traps. The emitter layer and/or the control layers may be subdivided to form electrically separately drivable regions.

Arrangements in accordance with the invention make it possible to drive, with two separately drivable heating layers, a raster of cathode spots in a matrix-like manner. The individual layers of an arrangement in accordance with the invention are successively deposited on a supporting substrate. A heating element which may optionally be provided with an insulating layer can advantageously be used as the supporting substrate.

A preferred method of manufacturing an inventive arrangement is characterized in that, prior to the deposition of further layers, the emitter layer is provided with a protective layer which covers at least the emissive regions of the emitter layer and which is removed after all layers have been provided. By virtue thereof, poisoning of the emissive surfaces during the provision of subsequent layers is precluded. In its simplest form, the protective layer may be a diaphragm covering the emissive regions of the emitter layer, however, in a preferred method, the protective layer is deposited on the entire surface area of the deposited emitter layer and, after the deposition of all layers, the layer is removed in the regions which serve as emissive surfaces. Preferably, the protective layer is made of metal, in particular tungsten.

The regions of the protective layer which are to be removed can be removed by means of chemical etching, in particular ion etching.

It is alternatively possible to use the excess thickness of the emitter layer as the protective layer.

Particularly for arrangements comprising a plurality of monolithically integrated controllable cathode elements, it is advantageous for the emitter layer to be manufactured from particles having sizes ranging from 1 to 100 nm, which are produced by laser ablation of a target. By means of such emitter layers, a particularly uniform electron emission is attained. The emissions of different surface elements having dimensions of, for example 1 μm, differ maximally 10%. For comparison, it is noted that metallurgically or electrophoretically produced emitter layers yield very irregular emission densities which, when comparing for example different surface elements having dimensions of approximately 100 μm, differ by powers of ten.

It has been found to be advantageous to provide the insulating layer or layers and/or the protective layer and/or the control layer or layers by means of a CVD process. If heated substrates are used or if the structure is heated/annealed after each layer, laser-ablation deposition can alternatively be used to build layers of a high density, in particular with pressures <0.1 hPa. Particularly suitable emissive layers and methods of manufacturing said layers are described in DE-A 4207220 and DE-A 4206909.

BRIEF DESCRIPTION OF THE DRAWING FIGURES

The invention will be explained in greater detail by means of exemplary embodiments and with reference to the accompanying drawings, in which FIG. 1 is a sectional view of an inventive arrangement comprising three emissive spots and several grids.

DESCRIPTION OF THE INVENTION

Figure 1:
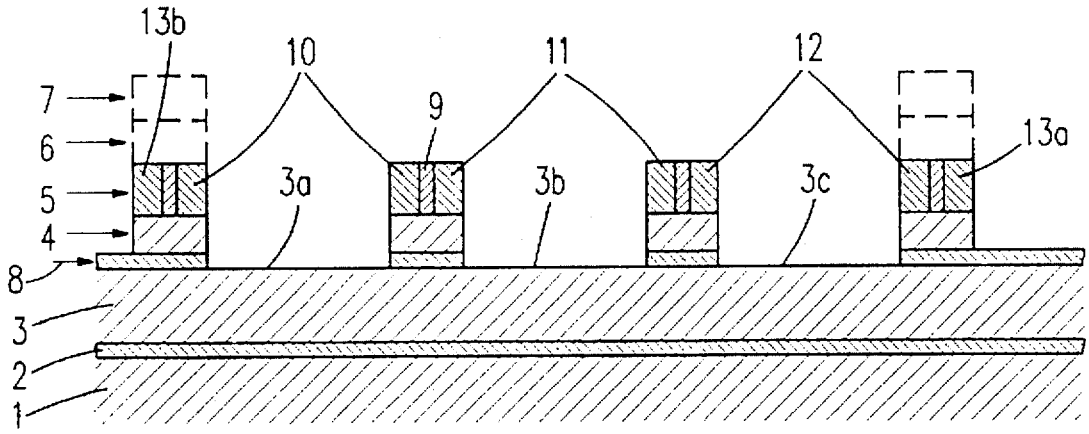

FIG. 1 schematically shows a controllable thermionic electron emitter for colour display tubes.

A heating element 1 is used as the support and substrate on which the following layers are deposited: an insulating layer 2, an emitter layer 3, a protective layer 8, an insulating layer 4, a grid layer 5 and, optionally, an insulating layer 6 and a grid layer 7.

The insulating layers consist of oxide layers, in particular BeO, $ZrO_2$ or $BaWO_4$, which are deposited by means of CVD or LAD and which have a thickness of approximately 80 μm. The approximately 70 μm thick emitter layer 3 was deposited as a porous structure consisting of parts having a diameter below 1 μm by means of LAD (or CVD).

The emitter layer consists, for example, of W+≦3% BaO or $4BaO{\cdot}CaO{\cdot}Al_2O_3$ and $Sc_2O_3$, in particular 2–3.5 wt % $Sc_2O_3$. In a further embodiment, the layer consists of oxide-cathode material, particularly BaO/SrO, doped with Ni particles and $Sc_2O_3$ particles in a quantity ≦1 wt %, BaO/SrO preferably being provided so that it has a percolation structure.

An approximately 100 μm thick metallic tungsten layer was deposited as a protective layer 8 on the emitter layer, with the protective layer serving to preclude, at a later stage, poisoning of the emissive surface regions 3*a* (red), 3*b* (green) and 3*c* (blue) when the subsequent layers are deposited. Subsequently, layers 4 and 5 were deposited and, initially, also covered the emissive surface regions. The material of the insulating layer 4 and of the grid layer 5 as well as of the protective layer 8 deposited on the emissive surfaces was removed by ion etching through an edge mask. Insulating slits 9 were formed, for example by laser ablation or etching with an ion beam, in the grid layer 5 to form individual grids which can be driven electrically. These slits can be filled up with insulating material. In this manner, individual grids 10, 11 and 12 were formed which surround the associated emissive regions 3*a*, 3*b* and 3*c*, respectively.

A grid 13 having cross-sectional areas 13*a* and 13*b* surrounds, as a common grid, all emissive regions 3*a*, 3*b* and 3*c*. A further common grid can be formed by the parts of the grid layer 7 which are indicated by interrupted lines.

Alternatively, the regions of the layers 4 to 7 shown in FIG. 1 can already be provided in the final configuration by means of correspondingly shaped diaphragms. By virtue thereof, the diaphragm may replace, in certain cases, the protective layer 8.

A tungsten protective layer 8 can also be removed by oxidation followed by evaporation. In addition, the protective layer 8 can be made from the same material as the emitter layer 3 and can be provided in a thickness which corresponds to the penetration depth of the poison when the subsequent layers are provided with the protective layer being removed at a later stage. In this case, initially, an oversized emitter layer is manufactured.

Figure 2:
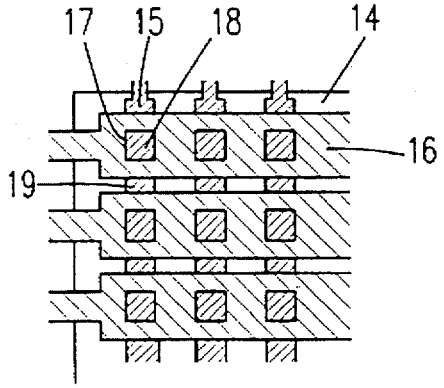
FIG. 2 shows a matrix arrangement.

Different versions of electron emitters for various applications can be manufactured in a similar manner as the exemplary arrangement of FIG. 1. In particular, matrix-like structures which correspond to the schematic representation of FIG. 2 can be formed. In FIG. 2, a heater 14 is provided with parallel emitter strips 15 above which grid strips 16 are arranged so as to extend perpendicularly thereto. Emissive surfaces 18 are exposed through gaps 17 in the grid strips 16, which emissive surfaces emit an electron beam when the emitter and grid strips 15 and 16 intersecting at these surfaces are simultaneously electrically driven. The structure shown in FIG. 2 was manufactured in accordance with the invention by successively providing single layers, which were subsequently subjected to etching processes. The parts of the emitter strips (for example 19) which are not to emit electrons are or remain covered, unlike the emitter spots 18, with a non-emissive protective layer.

Figure 3:
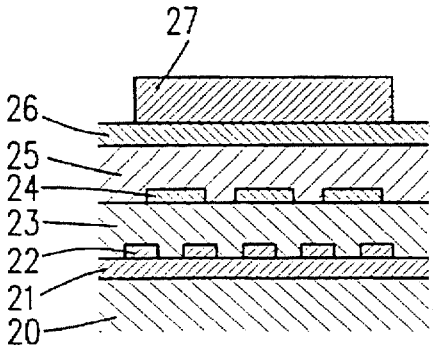
FIG. 3 shows an inventive arrangement comprising two heating layers.

Matrix-like drives can also be brought about by two heating layers which are arranged one above the other, as shown in FIG. 3. A support 20 was successively provided with an insulating layer 21, a meander-shaped heating element 22, an insulating layer 23, a meander-shaped heating element 24, an insulating layer 25, an electroconductive layer 26 and an emitter layer having an emissive spot 27. The heating elements 22 and 24 form part of heating strips which consist of numerous, similar heating elements which are arranged in rows. The heating strips containing the heating elements 22 and 24 extend perpendicularly to each other, in the same manner as shown in FIG. 2. The emissive surface 27 can only emit when current passes through the heating elements of both heating strips. The necessary heating power can be reduced by virtue of the fact that an additional stand-by-heating element is used for preheating to approximately 400° C.

We claim:

1. A method of manufacture of a controllable thermionic electron emitter device, comprising the steps of:

i) providing a supporting substrate;

ii) forming by deposition a layer of thermionic electron emissive material overlying said substrate;

iii) forming by deposition a layer of protective material on said layer of emissive material;

iv) forming by deposition a layer of insulating material on said layer of protective material;

v) forming by deposition a layer of electrically conductive material on said layer of insulating material;

vi) selectively etching through said layer of conductive material so as to form said layer of conductive material into individual grids that define individual emissive surface regions of said layer of emissive material; and vii) further selectively etching through said layer of insulating material and through said layer of protective material so as to expose said defined individual emissive surface regions of said layer of emissive material, said individual grids being adapted to be electrically actuated to control electron emission from said exposed emissive surface regions of said layer of emissive material.

2. A method as claimed in claim 1, wherein deposition of each of said layers is performed by vapor deposition of the material of the relevant layer.

3. A method as claimed in claim 1, further comprising forming by deposition a layer of insulating material on said substrate prior to deposition of said layer of electron emissive material.

4. A method as claimed in claim 1, wherein said layer of protective material comprises metallic tungsten.

5. A method as claimed in claim 1, wherein said layer of protective material is constituted by an additional thickness of said layer of emissive material.

6. A method as claimed in claim 1 wherein said substrate is a heating element.

7. A method as claimed in claim 1 wherein said layer of emissive material is deposited so as to form rows of emitter strips, said layer of conductive material is deposited so as to form rows of conductive strips arranged perpendicular to the rows of emitter strips, thereby forming a matrix, and in step (vi) an individual grid is formed at each intersection of perpendicular rows of said strips.

8. A method of manufacture of a controllable thermionic electron emitter device, comprising the steps of:

i) providing a supporting substrate;

ii) forming by deposition a first layer of insulating material on said substrate;

iii) forming by deposition a first row of individual heating strips on said first insulating layer;

iv) forming by deposition a second layer of insulating material overlying said first row of heating strips;

v) forming by deposition a second row of individual heating strips on said second insulating layer, the second row of heating strips being perpendicular to the first row of heating strips;

vi) forming by deposition a third layer of insulating material overlying said second row of heating strips;

vii) forming by deposition a layer of electroconductive material on said third layer of insulating material; and viii) forming by deposition a layer of thermionic electron emissive material on said layer of electroconductive material, whereby a thermionic electron emitter device is formed in which electrons are emitted from a surface region of said electron emissive material overlying an intersection of a particular heating strip of the first row of heating strips and a particular heating strip of the second row of heating strips only when the particular heating strips of the first and second rows of heating strips are both carrying current.

* * * * *